US006157284A

United States Patent [19]

Kanazawa

[11] Patent Number: 6,157,284

[45] Date of Patent: Dec. 5, 2000

[54] PACKAGING OF AN ELECTRIC CIRCUIT INCLUDING ONE OR MORE COILS

[75] Inventor: Masaki Kanazawa, Koganei, Japan

[73] Assignee: Sanken Electric Co., Ltd., Saitama Ken, Japan

[21] Appl. No.: 09/201,639

[22] Filed: Nov. 30, 1998

[30] Foreign Application Priority Data

Dec. 8, 1997 [JP] Japan ..... 9-356220

[51] Int. Cl.[7] ..... H01F 27/30

[52] U.S. Cl. ..... 336/198; 336/185; 336/192; 336/200

[58] Field of Search ..... 336/192, 198, 336/96, 98, 200, 185, 232

[56] References Cited

U.S. PATENT DOCUMENTS 4,760,366 7/1988 Mitsui ..... 336/233

4,939,494 7/1990 Masuda et al. ..... 336/96

5,034,854 7/1991 Matsumura et al. ..... 361/396

*Primary Examiner*—Lincoln Donovan

*Assistant Examiner*—Tuyen T. Nguyen

*Attorney, Agent, or Firm*—Woodcock Washburn Kurtz Mackiewicz & Norris LLP

[57] ABSTRACT

For packaging an electric circuit of the kind having a coil or coils in addition to electronic components such as transistors, diodes, and capacitors, a plastic molding is provided which comprises a bobbin with a pair of flanges on its opposite ends. The coils are wound on the bobbin and retained in position thereon by the flanges. The electronic components of the circuit, such as transistors and diodes, are all integrally embedded in one of the flanges and electrically connected to sheet-metal terminals which also are partly embedded in the same flange.

9 Claims, 6 Drawing Sheets

PACKAGING OF AN ELECTRIC CIRCUIT INCLUDING ONE OR MORE COILS

BACKGROUND OF THE INVENTION

This invention relates to improvements in or relating to the mechanical construction of an electric circuit including a coil or coils in addition to electronic components. More specifically, the invention pertains to how to assemble, both mechanically and electrically, the coil or coils and other components of such an electric circuit into a unitary, compact package.

There are many known electric circuits that are comprised of coils such as inductance coils and those of transformers, along with other components such as transistors, diodes, and capacitors. Conventionally, all such components have been mounted on a planar circuit board, and the coil or coils and some or all of the other components have been plastic encapsulated as required.

An objection to such conventionally packaged electric circuits is that they are mostly not nearly so compact as can be desired. The apparent lack of compactness is due obviously to the direct placement of the coil or coils on the circuit board. Coils are ordinarily far more bulky than the other components such as transistors, capacitors, and resistors. Because of their large surface requirements on the circuit board the coils have necessitated the use of an inconveniently large circuit board, presenting a bar to the miniaturization of packaged electric circuits of the kind in question. Obviously, no further reduction in size is possible unless a completely different packaging scheme, involving coil displacement from the circuit board, is invented.

The manufacture of such electric circuit packages has also been a very troublesome and time-consuming procedure partly because of the complex electric connections that must be made among the various components. Difficulties have been met, for example, in connecting the coil extremities to the conductor pattern on the circuit board, and attaching terminals to the circuit board.

SUMMARY OF THE INVENTION

It is therefore among the objects of this invention to make materially more compact the packages of electric circuits including a coil or coils.

Another object of the invention is to retain the coil or coils in place on the package against any accidental displacement.

Still another object of the invention is to permit the iron core, if any, of the coil or coils to be readily and compactly mounted to the package.

A further object of the invention is to make the core function as a heat radiator, thereby protecting the electronic components from over-heating.

A further object of the invention is to expedite the packaging of the electric circuits of the kind defined.

A still further object of the invention is to facilitate the electric connection of the coil or coils to the other components of the electric circuit packaged.

Briefly stated in one aspect thereof, the present invention concerns a package for an electric circuit of the kind having a coil and one or more electronic components. The package comprises a substantially boxlike base of electrically insulating material in which the electronic components of the circuit are integrally embedded, and a bobbin erected on the base and formed in one piece therewith, the bobbin being adapted to permit a coil of the electric circuit to be wound thereon.

Thus the packaging scheme according to the invention permits the coil to be disposed over the electronic components. The resulting package is far more compact, at least in the sense that it requires less installation area, than in the conventional case where the coil and the electronic components are disposed in coplanar relationship to each other.

The package of the foregoing configuration, with the electronic components embedded in its base, is easy to fabricate by insert molding. The coil or coils are to be wound later on the bobbin of the insert-molded package. The electric connection of the coil or coils to the embedded electronic components can be readily accomplished by subsequently connecting the coil extremities to the terminals projecting from the package base.

According to a further feature of the invention a flange is integrally formed on one end of the bobbin, the other end thereof being joined to the base. The coil or coils can therefore be positively held in place on the bobbin by the flange and the base.

If the coil or coils of the packaged electric circuit are to be provided with a magnetic core, such a core can be inserted in a hole formed axially through the bobbin. The core will serve to better magnetically couple the two or more coils together and, if only one coil is wound on the bobbin, to increase its inductance.

Preferably, there may be employed a pair of E-shaped core members each having a center leg and a pair of outer legs. The center legs of both core members may be inserted in the bobbin hole from its opposite ends to serve conjointly as magnetic core for the coil or coils, and the pairs of outer legs may be disposed outside the bobbin. The exposed outer legs of the core members, and their additional exposed limbs interconnecting the three legs, will then serve as heat radiators, the core members being better heat conductors than the package which is of epoxy resin or like plastic.

In order to expedite the mounting the core members in position on the package, indentations may be formed as in the base and flange of the package for snugly receiving parts of the core members. Such indentations will serve not only to position the core members on the package and to reduce the total size of the device including the exposed parts of the core members.

The above and other objects, features and advantages of this invention will become more apparent, and the invention itself will best be understood, from a study of the following description and appended drawings, with reference had to the attached drawings a preferable embodiment of the invention.

DESCRIPTION OF THE PREFERRED EMBODIMENT

Figure 1:
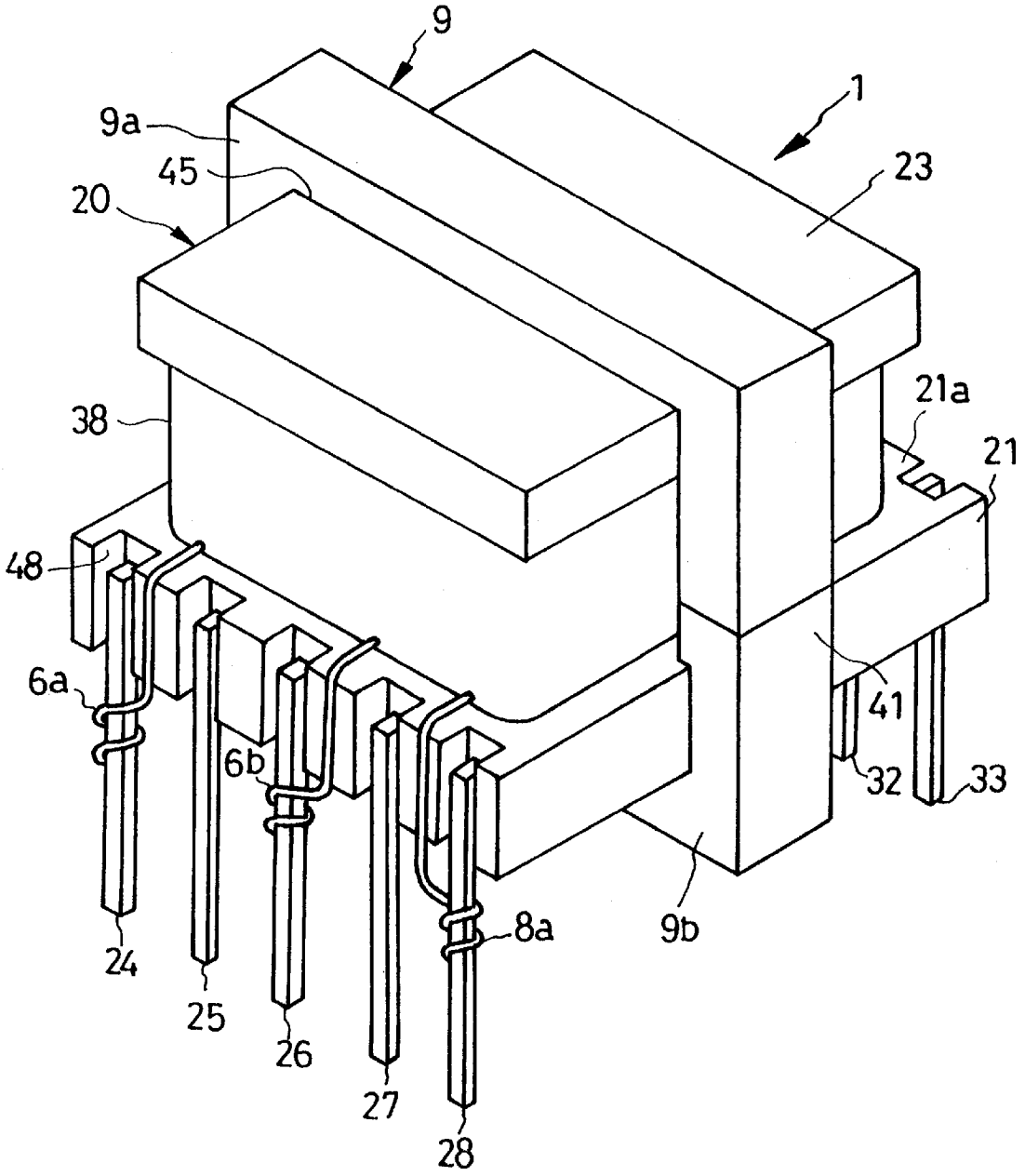
FIG. 1 is a perspective view of an electric circuit as packaged according to this invention, the particular circuit packaged being a d.c.-to-d.c. converter having three transformer coils.

The invention will now be described in detail as applied to the packaging of a d.c.-to-d.c. converter, an electronic circuit for converting one direct-current voltage into another. Pictured in FIG. 1 is a packaged d.c.-to-d.c. converter 1 according to the invention, including a package 20 which preferably is transfer-molded from epoxy resin, although other molding methods and other plastics may be employed as required or desired.

Figure 2:
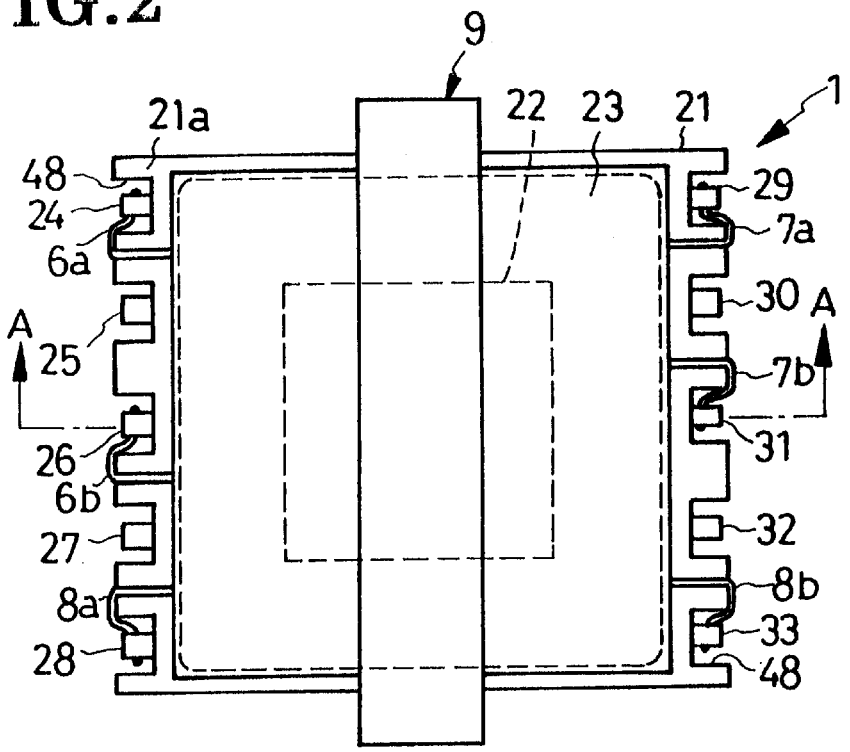
FIG. 2 is a top plan of the package of FIG. 1.
Figure 3:
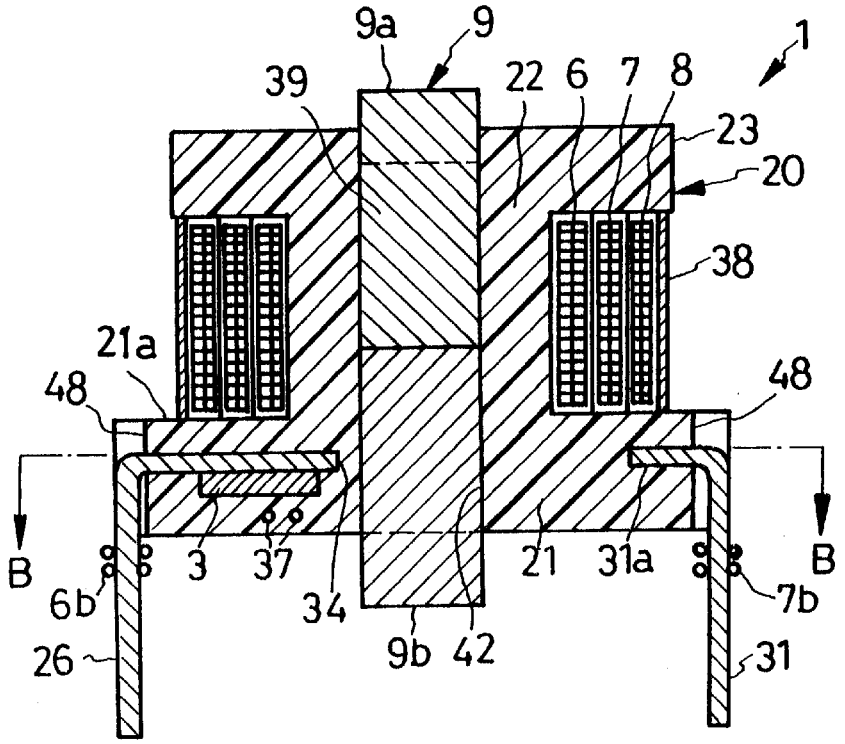
FIG. 3 is a vertical section through the packaged d.c.-to-d.c. converter, taken along the line A—A in FIG. 2 and revealing the three transformer coils of the converter which are wound concentrically on the bobbin of the package.

As will be seen also from FIGS. 2 and 3, the package 20 is a one-piece molding of a substantially boxlike base 21, a bobbin 22 erected centrally on a major surface 21*a* of the base, and a flange 23 on the top end of the bobbin. Parts other than the transformer coils of the d.c.-to-d.c. converter are integrally embedded in the base 21, and the coils are wound on the bobbin 22, which is shown in FIG. 2 as being square in cross sectional shape. However, the base 21 might be considered a bottom flange on the bobbin 22; indeed, the base is intended to function as such, coacting with the top flange 23 to positively retain the coils in place on the bobbin, in addition to as a housing for the electronic components of the converter.

Before proceeding further with the description of the package 20, the circuit configuration of the d.c.-to-d.c. converter to be packaged will be briefly explained with reference to FIG. 4. Seen at 2 in this circuit diagram is a transformer having a primary 6, a secondary 7 and a tertiary 8 winding or coil with a common magnetic core 9. The primary 6 has its opposite extremities connected to terminals 10 and 11, the secondary 7 to terminals 12 and 13, and the tertiary 8 to terminals 14 and 15, respectively.

As electronic components the d.c.-to-d.c. converter has a transistor 3, a control circuit 4 and a rectifier diode 5. The transistor 3 is connected between the terminal 11 of the transformer primary 6 and a grounded terminal 16. The control circuit 4, which is understood to be fabricated in the form of a hybrid integrated circuit, is connected to both terminals 14 and 15 of the transformer tertiary 8, and to both base and emitter of the transistor 3, for on-off control of the transistor according to the voltage across the transformer tertiary. The diode 5 is connected between the terminal 12 of the transformer secondary 7 and an output terminal 17.

Figure 4:
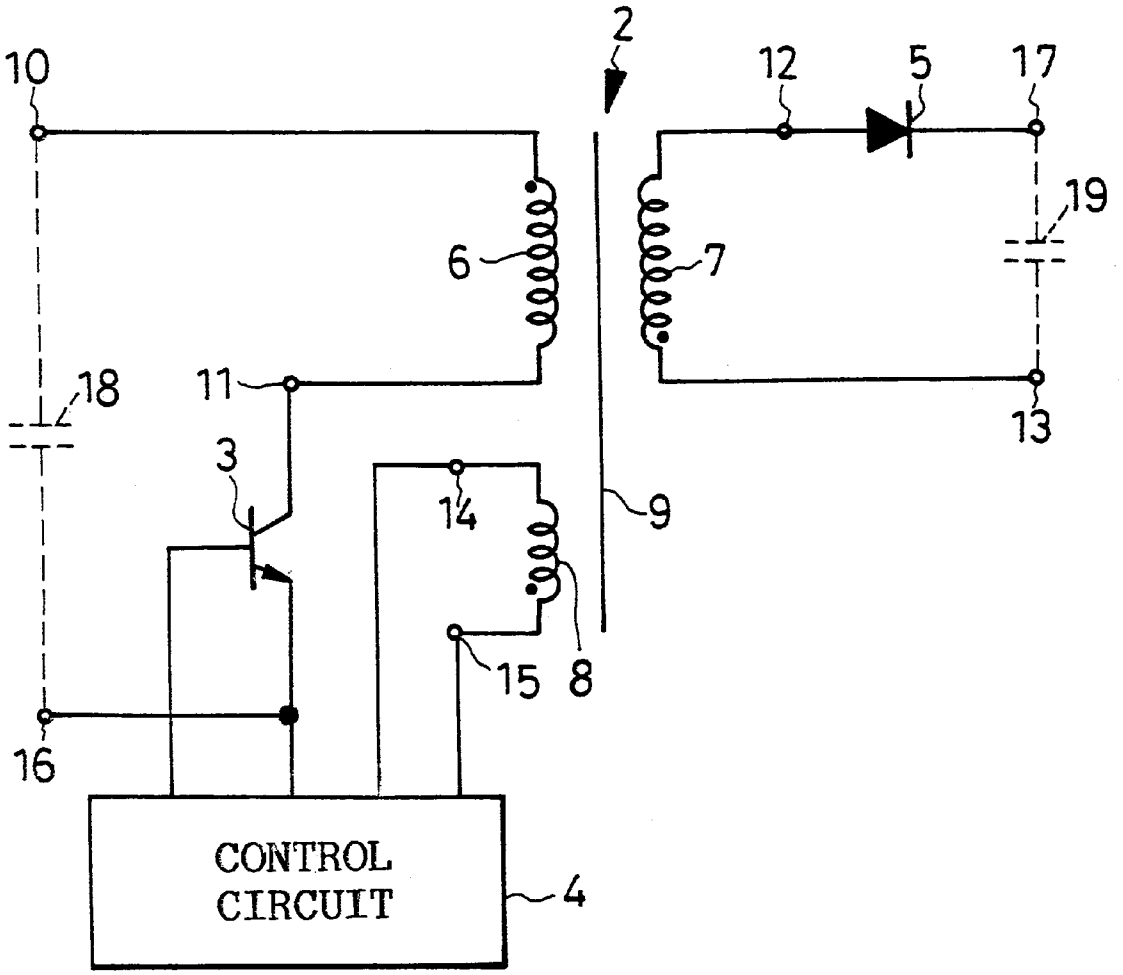
FIG. 4 is a schematic electric diagram of the d.c.-to-d.c. converter packaged as in FIGS. 1–3.

As indicated by the broken lines in FIG. 4, a voltage smoothing or stabilizing capacitor 18 may be connected between the terminal 10 of the transformer primary 6 and the grounded terminal 16. Incidentally, for a.c.-to-d.c. conversion, a rectifier circuit, not shown, may also be connected between these terminals 10 and 16. Another smoothing capacitor 19 may be connected between the output terminal 17 and the terminal 13 of the transformer secondary 7. The two phantom capacitors 18 and 19 and the unshown rectifier circuit are excluded from the packaged d.c.-to-d.c. converter 1 shown but could be packaged along with the electronic components 3, 4 and 5.

Figure 5:
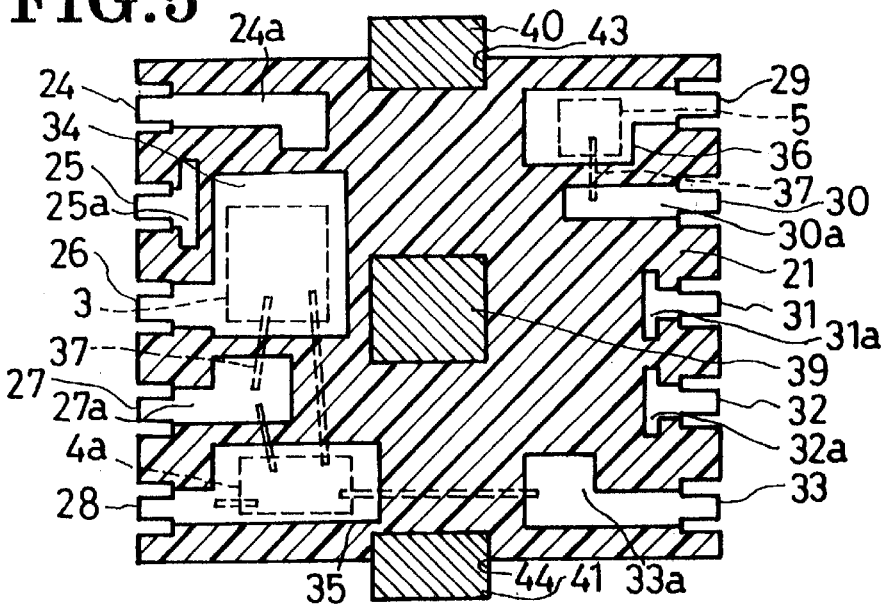
FIG. 5 is a horizontal section through the packaged d.c.-to-d.c. converter, showing in particular the electronic components and terminal members integrally embedded in the base of the package.

FIG. 5 reveals that the transistor 3, control circuit 4 and diode 5 of the FIG. 4 d.c.-to-d.c. converter are all buried in the base 21 of the package 20, the control circuit as a control circuit assembly 4*a* inclusive of a circuit board. Also seen in this figure, and partly in FIGS. 1–3, are a plurality of, ten in the illustrated embodiment, sheet-metal terminals 24, 25, 26, 27, 28, 29, 30, 31, 32 and 33 and a plurality of, three in the illustrated embodiment, sheet-metal seats 34, 35 and 36 for the electronic components 3, 4*a* and 5.

The transistor 3, control circuit assembly 4*a* and diode 5 are soldered or bonded to the seats 34, 35 and 36, respectively, which in turn are joined to the terminals 26, 28 and 29, respectively. The seats 34–36 together with the electronic components 3, 4*a* and 5 thereon, as well as parts of the associated terminals 26, 28 and 29, are all buried in the base 21 of the package 20, with the remainders of the three terminals projecting outwardly therefrom. Parts of the other terminals 24, 25, 27, 30, 31, 32 and 33 with their variously enlarged ends 24*a*, 25*a*, 27*a*, 30*a*, 31*a*, 32*a* and 33*a* are likewise buried in the base 21, and the remainders of these terminals project outwardly therefrom. The projecting parts of the terminals 24–33 are all shown bent downwardly, that is, in a direction away from the bobbin 22.

In FIG. 3 is shown the transistor 3 as underlying the seat 34, the other electronic components 4*a* and 5 being also understood to underlie their seats 35 and 36. This placement of the electronic components is not essential, however; in practice, they may all overlie the seats, or some overlie, and others underlie, the seats.

FIG. 5 additionally indicates wire conductors 37 of various lengths employed to electrically interconnect the various parts of the d.c.-to-d.c. converter and hence to complete the circuitry of FIG. 4. Such conductors connect the emitter of the transistor 3 and the terminal 27; the base of the transistor and the control circuit assembly 4*a*; the control circuit assembly and the terminal 27; the control circuit assembly and the mounting plate 35; the control circuit assembly and the terminal 33; and the diode 5 and the terminal 30. All these conductors 37 are also buried in the package base 21, as seen in parts in FIG. 3.

As best shown in FIG. 3, the three coils 6–8 of the transformer 2, FIG. 4, are wound concentrically on the bobbin 22 of the package 20, with the primary 6 inmost, then the secondary 7, and the tertiary 8 outmost. An insulating tape 38 is additionally wound on the tertiary 8 by way of protection. The concentric coil arrangement is not essential; alternatively, the three coils could be wound on axially different portions of the bobbin 22.

Wound either way on the bobbin 22, the transformer coils 6–8 are positively retained against displacement in either axial direction relative to the bobbin by the base 21 and the flange 23. Essentially, the package 20 according to the invention might be described as being in the shape of a double flanged bobbin or spool, with the bobbin itself carrying the coils and one of the flanges doubling as a compact enclosure for the other components of the d.c.-to-d.c. converter.

As shown in FIG. 2 and partly in FIGS. 1 and 3, according to the FIG. 4 circuit configuration, the transformer primary 6 has one extremity 6*a* connected to the terminal 24 and another extremity 6*b* to the terminal 26. The transformer secondary 7 has one extremity 7*a* connected to the terminal 29 and another extremity 7*b* to the terminal 31. The transformer tertiary 8 has one extremity 8*a* connected to the terminal 28 and another extremity 8*b* to the terminal 33. For proper electric connection of the transformer coils to the terminals the end portions of the coiled wires may be wound several turns around the terminals, as best depicted in FIG. 1, and solder may be applied to the joints. For illustrative convenience, however, the applied solder is not shown in FIGS. 1–3, and the connections themselves are not shown in FIG. 5.

Figure 6:
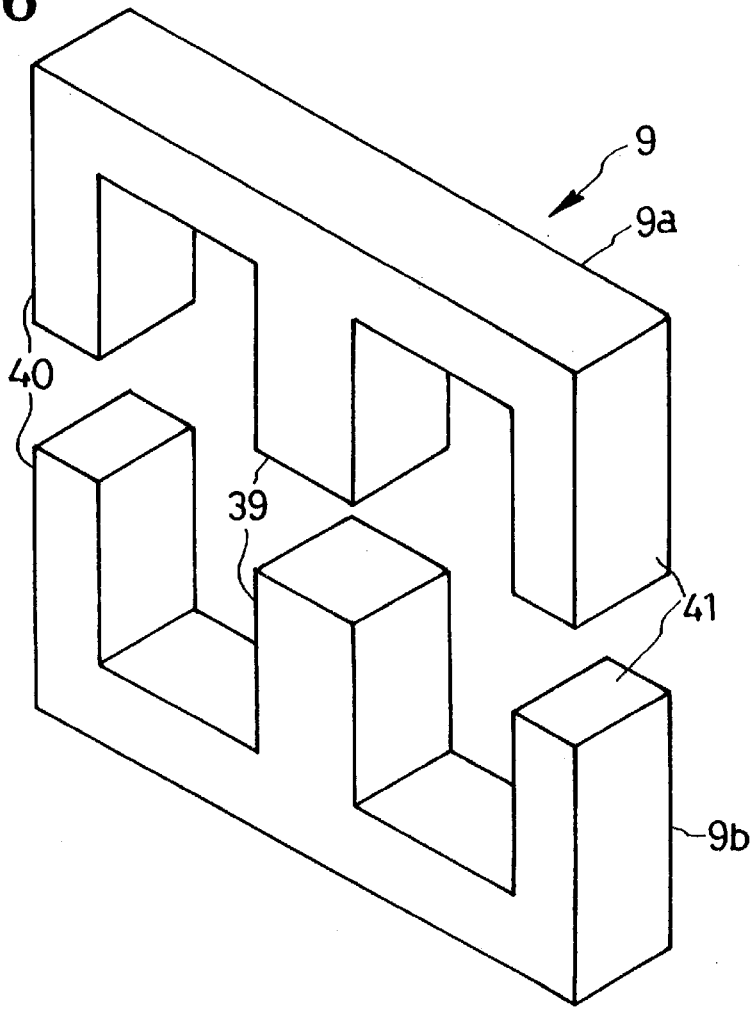
FIG. 6 is a perspective view of a pair of E-shaped core members used in the FIG. 1 device to provide a core for the transformer coils of the converter.

The transformer 2, FIG. 4, of the d.c.-to-d.c. converter is therein shown to have a magnetic core 9 for magnetically coupling the coils 6–8 together. Seen in FIG. 6 are a pair of identically E-shaped core halves 9*a* and 9*b* employed in the illustrated converter package for providing the transformer coil core 9. The core halves 9*a* and 9*b* each include a center leg 39 and a pair of outer legs 40 and 41. Each core half may be of laminated sheet steel or of ferrite.

As best revealed in FIG. 3, the center legs 39 of the core halves 9*a* and 9*b* are inserted from opposite directions into a hole 42 extending centrally through the base 21, bobbin 22 and flange 23 of the package 20. It is these center legs 39 that serve primarily as the core of the transformer coils 6–8.

Figure 7:
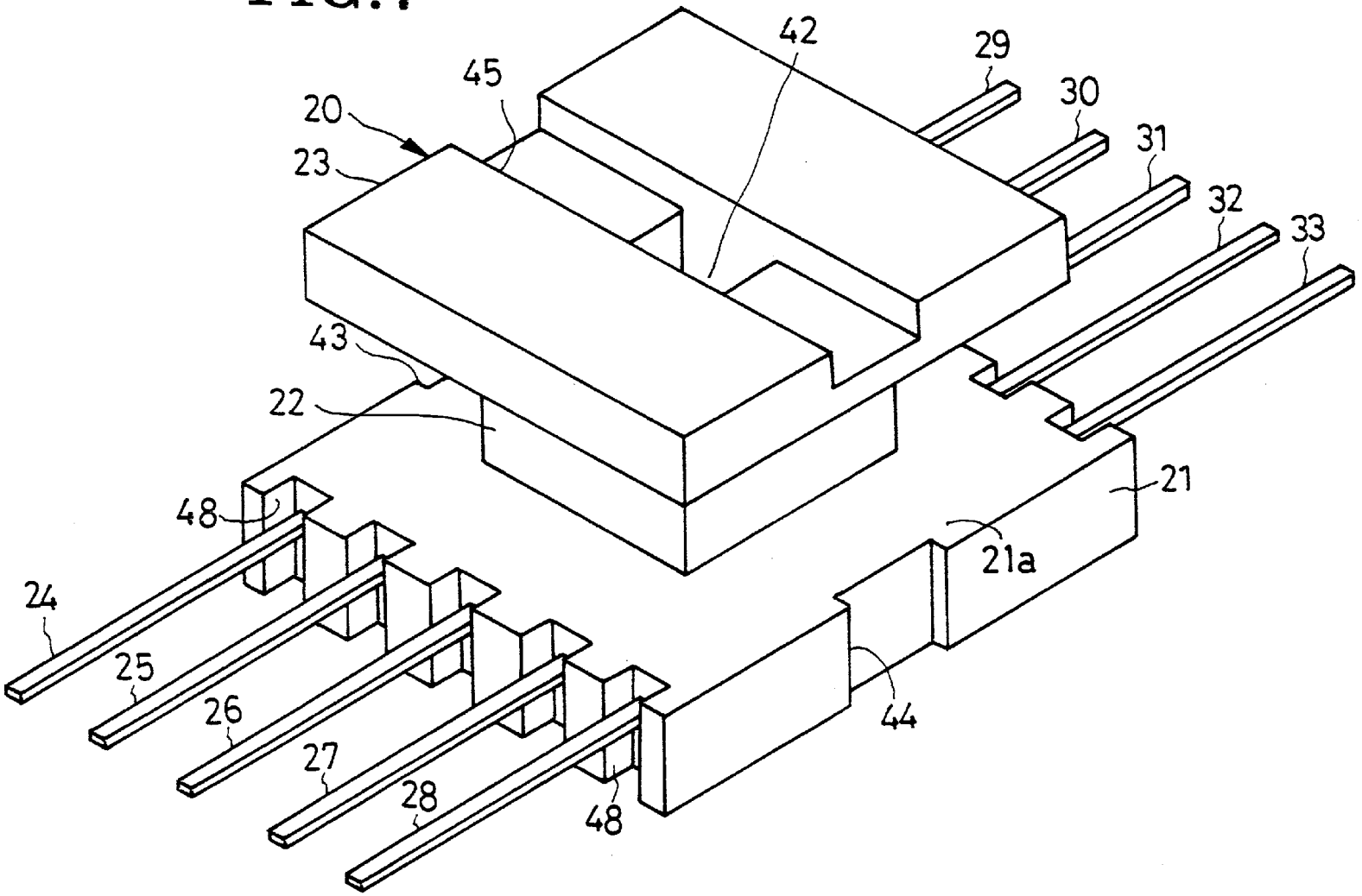
FIG. 7 is a perspective view of the FIG. 1 package just after being insert molded with the electronic components and terminals of the d.c.-to-d.c. converter, the view not showing, therefore, the coils and core members which are to be mounted subsequently to the package.

Preferably, and as indicated in FIG. 7, the base 21 may be provided with a pair of indentations 43 and 44 in its two opposite sides for receiving the outer legs 40 and 41 of one core half 9*b*. The flange 23 may also be provided with an indentation 45 for receiving part of the core half 9*a*. Such indentations are intended to serve both to reduce the total size of the packaged product and to position the core halves 9*a* and 9*b* on the package 20.

Inserted as above in the hole 42 and positioned as above on the package 20, the pair of core halves 9*a* and 9*b* are to be mechanically clamped or bonded together against the risk of accidental detachment. As may now be apparent, the use of two identically E-shaped core halves is unessential; alternatively, for example, there may be employed one E-shaped member and one I-shaped one.

Figure 8:
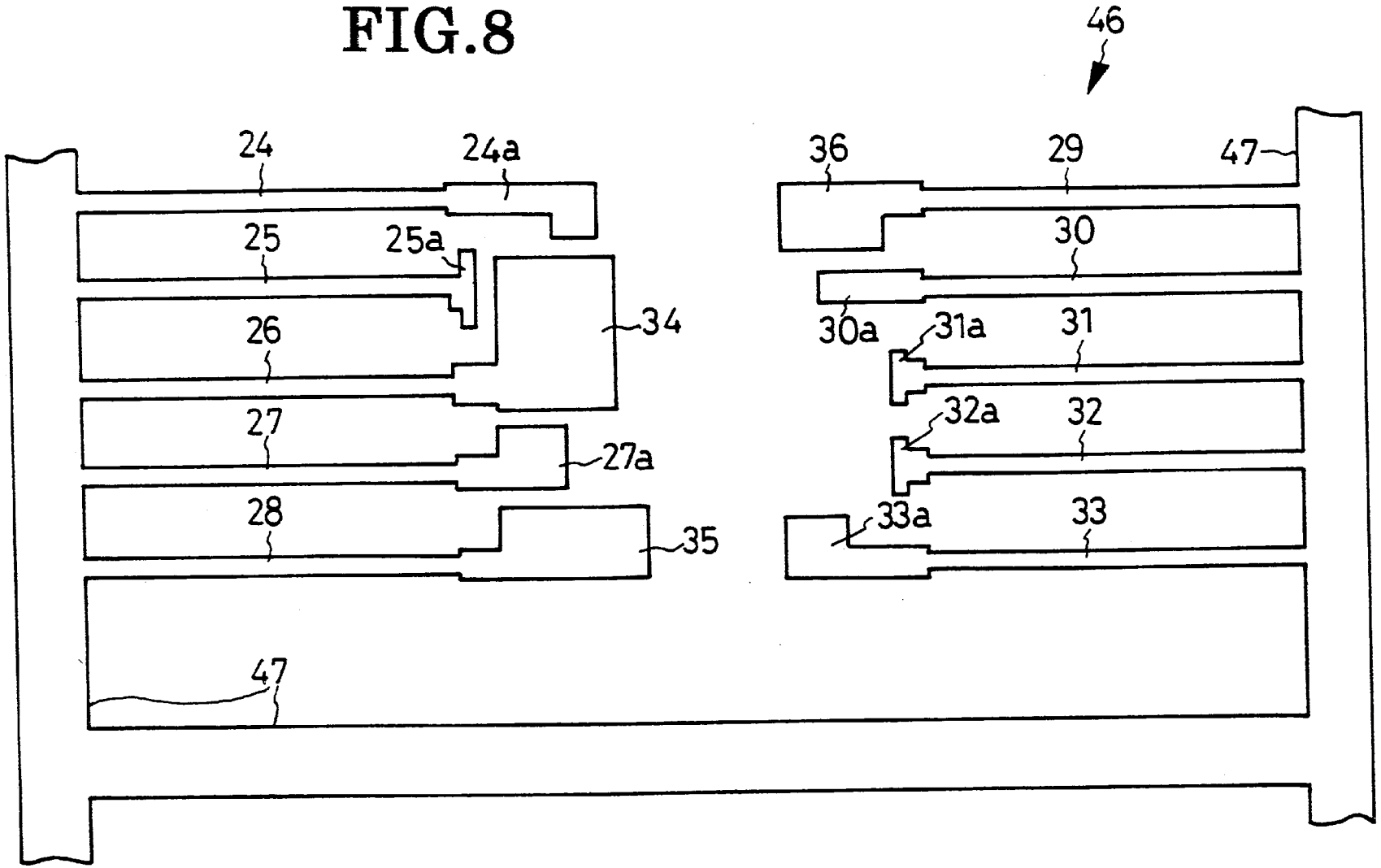
FIG. 8 is a plan view of a sheet metal punching including the terminals and electronic component seats to be inserted in the base of the package when it is molded as in FIG. 7.

The fabrication of the packaged d.c.-to-d.c. converter according to the invention will be greatly facilitated by use of a sheet metal punching shown in FIG. 8 and therein generally designated 46. This punching 46 includes the terminals 24–33, the three electronic component seats 34–36, and connective portions 47 interconnecting the terminals and seats and holding them in their relative positions. The connective portions 47 are to be cut off and discarded, or reused in one way or another, after the terminals and seats have been embedded in the base 21.

The transistor 3 in chip form, control circuit assembly 4, and diode 5 in chip form may first be mounted fast to the seats 34–36 of the punching 46. The various electric connections of FIG. 4 by the wire conductors 37 may also be made on the punching 46 by any known or suitable method such as heat sealing or ultrasonic welding.

Then all but the connective portions 47 and the required length of the terminals 24–33 of the punching 46, together with the electronic components 3–5 and the wire connections 37 thereon, may be placed in a mold cavity for the production of the package 20. Then, softened by heat and pressure in a transfer chamber, epoxy resin may be forced at high pressure into the mold cavity for final curing. The connective portions 47 of the punching 46 may be cut off upon completion of the curing.

FIG. 7 is an illustration of the package 20 that has been insert molded as above with the electronic components 3–5 integrally embedded in its base 21 and the required lengths of the terminals 24–33 projecting outwardly, still all in coplanar relationship to one another.

Then, preferably before bending the terminals 24–33, insulated wires may be wound on the bobbin 22 to form the three transformer coils 6–8 of concentric arrangement as in FIG. 3. Then, with the terminals 24–33 still held unbent, the opposite extremities 6*a* and 6*b* of the transformer primary 6 may be wound and soldered to the terminals 24 and 26, the opposite extremities 7*a* and 7*b* of the transformer secondary 7 to the terminals 29 and 31, and the opposite extremities 8*a* and 8*b* of the transformer tertiary 8 to the terminals 28 and 33.

Then all the terminals 24–33 may be bent right-angularly down as in FIG. 1, thereby completing the manufacture of the packaged converter. The base 21 of the package 20 has a series of indentations 48 formed in its two opposite sides. All the leads 24–33 are partly received one in each indentation 48 by way of protection as well as electric isolation from one another. The bending of the terminals is not a necessity, however.

The packaging of electric circuits such as the FIG. 4 d.c.-to-d.c. converter according to this invention, and the packaged circuits themselves, gain the following advantages:

1. The base 21 housing all the electronic components 3–5 of the packaged circuit underlies the bobbin 22 on which the coils 6–8 of the circuit are wound. The package is therefore far more compact than in the case where the coils and the electronic components were disposed on one and the same plane.

2. The base 21 serves also as a flange on the bobbin 22.

3. Packaging is easy, speedy and inexpensive of manufacture as the base 21, bobbin 22 and flange 23 are insert molded in one piece, with all the terminals 24–33 and component seats 34–36 interconnected and held in correct relative positions in the form of the punching 46.

4. The electric connections of the transformer coils 6–8 to the electronic components 3–5 are easy as the coil extremities 6*a*, 6*b*, 7*s*, 7*b*, 8*a* and 8*b* are connected to the exposed terminals 24, 26, 28, 29, 31 and 33 rather than to the embedded parts of the circuit.

5. The pair of core halves 9*a* and 9*b* can be easily and precisely positioned on the package 20 by being snugly engaged in the indentations 43 and 44 in the package base 21 and in the indentation 45 in the flange 23.

6. The terminals 24–33 are mechanically protected and electrically isolated from one another by being received in the indentations 48 in the base 21.

7. The pair of core halves 9*a* and 9*b*, being a better heat conductor than the package 20, serves the additional purpose of heat radiation, guarding the electronic components 3–5 against overheating.

Notwithstanding the foregoing detailed disclosure it is not desired that the present invention be limited by the exact showing of the drawings or the description thereof. The following is a brief list of possible modifications, alterations and adaptations of the illustrated embodiment which are all believed to fall within the scope of this invention:

1. The packaging scheme of this invention is applicable to circuits having choke coils, rectifying and smoothing circuits, amplifying circuits including an insulating transformer, and many others in addition to the exemplified d.c.-to-d.c. converter.

2. The bobbin of the package could be cylindrical, and the base and the flange cylindrical or disklike, in shape.

3. A pot core may be employed for reduction of flux leakage.

4. The terminals 33 and 28 could be juxtaposed or otherwise disposed closer together in order to make possible the electric connection of the control circuit assembly 4*a* and the terminal 33 with a shorter wire.

What is claimed is:

1. A packaged electric circuit comprising:

a package of electrically insulating material comprising a boxlike base having a major surface, and a bobbin erected centrally on the major surface of the base;

a coil wound on the bobbin of the package;

a plurality of terminals embedded in the base of the package, a portion of each terminal extending outwardly therefrom, at least one of the terminals being electrically connected to the coil;

a mounting plate formed integrally with at least one of the terminals and embedded in the base of the package; and an electronic component mounted on the mounting plate and embedded in the base of the package.

2. A packaged electric circuit as recited in claim 1, further comprising a magnetic core for the coil, the core being received in a hole extending through the bobbin of the package.

3. A packaged electric circuit as recited in claim 1, wherein the package further integrally comprises a flange formed on one end of the bobbin, another end thereof being joined to the base, whereby the coil can be held in place on the bobbin by the flange and the base.

4. A packaged electric circuit as recited in claim 3, further comprising an E-shaped core member of magnetic material having a center leg received in a hole extending through the bobbin and the flange of the package to serve as a magnetic core for the coil, and a pair of outer legs disposed outside the bobbin.

5. A packaged electric circuit as recited in claim 4, wherein the flange of the package has an indentation formed therein for receiving part of the core member.

6. A packaged electric circuit as recited in claim 3, further comprising a pair of E-shaped core members of magnetic material each having a center leg received in a hole extending through the bobbin and the base and the flange of the package to serve as part of a magnetic core for the coil, and a pair of outer legs disposed outside the bobbin.

7. A packaged electric circuit as recited in claim 6, wherein the base of the package has a pair of indentations formed therein for receiving parts of the outer legs of one of the core members.

8. A packaged electric circuit as recited in claim 1, further comprising a plurality of conductors embedded in the base of the package and providing electric connections between the electronic components and at least one of the terminals.

9. A packaged electric circuit as recited in claim 1, wherein the coil has extremities thereof connected to those parts of some of the terminals which extend outwardly of the base of the package.

* * * * *